US006502710B1

(12) United States Patent
Bösl et al.

(10) Patent No.: US 6,502,710 B1
(45) Date of Patent: Jan. 7, 2003

(54) CLOSURE CAP

(75) Inventors: Udo Bösl, Eimeldingen (DE); Georg Pfefferkorn, Müllheim (DE)

(73) Assignee: Crown Cork & Steal Technologies Corporation, Alsip, IL (US)

( * ) Notice: Subject to any disclaimer, the term of this patent is extended or adjusted under 35 U.S.C. 154(b) by 0 days.

(21) Appl. No.: 09/787,046

(22) PCT Filed: Aug. 16, 1999

(86) PCT No.: PCT/EP99/06000

§ 371 (c)(1),
(2), (4) Date: May 7, 2001

(87) PCT Pub. No.: WO00/15505

PCT Pub. Date: Mar. 23, 2000

(30) Foreign Application Priority Data

Sep. 14, 1998 (EP) ..... 98810913

(51) Int. Cl.[7] ..... B65D 53/00
(52) U.S. Cl. ..... 215/351; 215/307; 215/350
(58) Field of Search ..... 215/307, 349, 215/350, 351

(56) References Cited

U.S. PATENT DOCUMENTS 2,032,931 A * 3/1936 Gibbs ..... 215/260
2,804,225 A * 8/1957 Lee ..... 215/262
3,114,467 A 12/1963 Montgomery
4,346,812 A * 8/1982 Banich, Sr. ..... 215/352
4,560,077 A * 12/1985 Dutt ..... 215/307
4,880,127 A * 11/1989 Doi ..... 215/252
5,743,420 A * 4/1998 Loffler et al. ..... 215/270
5,785,196 A 7/1998 Montgomery
6,202,870 B1 * 3/2001 Pearce ..... 215/235

FOREIGN PATENT DOCUMENTS

EP 055 916 7/1982
EP 0 370 272 A1 5/1990
FR 851.275 * 1/1940 ..... 215/349
GB 1083149 9/1967

* cited by examiner

*Primary Examiner*—Jes F. Pascua
(74) *Attorney, Agent, or Firm*—Woodcock Washburn LLP

(57) ABSTRACT

A closure cap (1) for a container consists essentially of a cap base (2), of a cap skirt (3) and of a sealing disk (5) which bears at least partly on the cap base (2). A circumferential bulge (6) is arranged in the transition region (7) between the cap base (2) and the cap skirt (3). The bulge (6) serves for pressing the sealing disk (5) onto the container opening. The bulge (6) is divided by interruptions (8) into several blocks (9). On the inner side (10) of the cap base (2) there is arranged at least one rib (11) running radially outwards. The, rib seen in the circumferential direction, is located neighboring one of the interruptions.

5 Claims, 2 Drawing Sheets

CLOSURE CAP

BACKGROUND OF INVENTION

The invention relates to a closure cap that maybe brought into engagement with a container.

Closure caps of plastic material are used in a multitude of applications for closing containers. For achieving an adequate sealing effect, it is known to lay a sealing inlay of a softer material onto the inner side of the cap base. So that the outer upper edge of the container to be closed is adequately sealed, it is for example known in EP 55 916, in the region of the transition between the cap base and the cap skirt, to provide a circumferential pressing bulge which presses the sealing disk against the edge of the container opening. With such a design, good sealing results are achieved.

If such closures are used in combination with a container in which in the course of time an increased inner pressure may build up, the good sealing property may lead to certain problems. If the inner pressure in the container, for example, increases by heating or by fermentation of the contents, on account of the good sealing there exists the risk that the container explodes.

EP 370 272 therefore suggests providing the circumferential bulge with segment-like interruptions. In the region of these interruptions the sealing inlay may be pressed outwards. With this gas may escape and the inner pressure may be reduced.

The closure cap according to EP 370 272 is however burdened with the disadvantage that in the region of the segment-like interruptions the sealing effect also with a normal inner pressure is no longer optimal. With this there exists the danger of leakages under normal conditions.

It is a goal to provide a closure cap which permits an adequate sealing of the container opening at normal conditions and which in spite of this permits the reduction of an increased inner pressure.

SUMMARY

The closure cap for a container comprises a cap base and a cap skirt. The cap skirt is provided with inner retaining elements which can be brought into engagement with outer retaining elements on the opening of the container. The closure cap furthermore comprises a sealing disk which at least partly lies on the cap base and which can be pressed against the opening of the container. The closure cap is furthermore provided with a bulge in the transition region between the cap base and the cap skirt. The bulge serves for pressing the sealing disk onto the upper, outer edge of the opening of the container. The bulge is furthermore divided by at least one segment-like interruption into several blocks. If the inner pressure in the container rises, the sealing disk in the region of the interruptions may be forced radially outwards, by which means a reduction of the inner pressure is made possible. Of course the sealing disk may also be formed annularly.

The closure cap is, because of the venting behavior, above all particularly suitable for carbonated beverages, fruit juices and hot fillings.

According to the present invention the cap base on its inner side is provided with at least one rib running radially outwards. The rib extends radially at least over one sealing section on the inner side of the head plate. Sealing section here and in the following is to be understood as a section of the inner side of the head plate by way of which the sealing disk can be pressed against the opening of the container to be closed, in particular against the end-face side. The rib on the inner side of the cap base, seen in the circumferential direction, is arranged neighbouring the interruptions between the individual blocks of the bulge for the pressing of the sealing disk.

The arrangement of the radial ribs neighbouring the interruptions leads to a reliable sealing and in spite of this ensures venting of gas at an increased inner pressure. With a normal pressure the sealing disk in the region of the radial rib is pressed against the container opening. Also in the region of the interruption between the blocks of the bulge therefore a good sealing is ensured. If however the inner pressure in the container rises the cap base on account of the increased inner pressure is raised (so-called doming). With this the radial ribs are relieved of pressure. The sealing effect of the sealing disk in the region of the interruptions between the blocks of the bulge is as a result reduced. The excess pressure may therefore vent particularly well in the region of the rib and the interruption.

Preferably several interruptions are arranged in the bulge so that there are formed several blocks. Advantageously at least one radial rib is arranged radially flush to each interruption. This leads to a particularly uniform venting function. It is however also conceivable to arrange several radial ribs for each interruption. With several ribs, additionally between the ribs there is formed a venting channel into which the sealing disk may be displaced.

Preferably the angular extension of the ribs is selected smaller than the angular extension of the interruptions. As a result between the outer bordering line of the rib and the interruption between the blocks, additionally channels for venting are formed. With an increased inner pressure the sealing disk may be displaced into these channels.

Preferably the closure cap is roughly provided with 9 interruptions and 9 blocks and radial ribs. This value corresponds to an optimal compromise between sealing and bleeding properties.

The interruptions advantageously extend over an angle of about 5° to 30°.

For increasing the pressing of the sealing disk additionally on the cap base there is provided a circumferential rib which has a lesser thickness than the radial rib.

The invention is hereinafter described in more detail in embodiment examples and by way of the drawings.

DETAILED DESCRIPTION OF PREFERRED EMBODIMENTS

Figure 1:
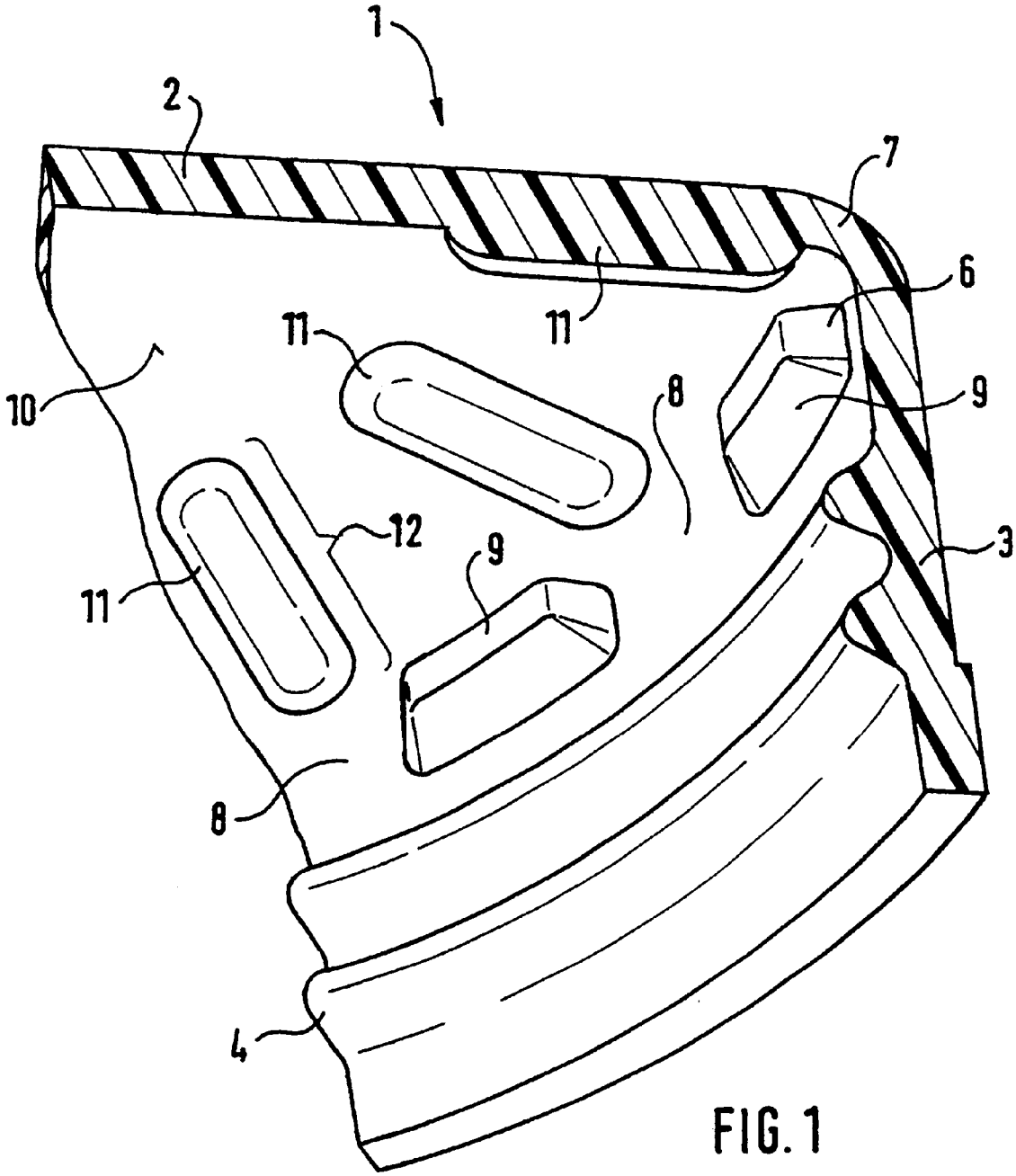
FIG. 1 perspective representation of a cutout of a closure cap according to the invention.

In FIG. 1, perspectively and in section there is shown a cutout of a closure cap 1. The closure cap 1 comprises a cap base 2 and a cap skirt 3. The cap skirt 3 in a transition region 7 meets the cap base 2. On the inner side of the cap skirt 3 there is arranged a screw thread 4 for fastening the closure cap I onto a container 20 (see FIG. 3). In the transition range 7 there is arranged a circumferential bulge 6. The bulge 6 serves the pressing of a flexible sealing disk 5 (in FIG. 1 not shown, see FIG. 3) onto the opening of the container 20. The bulge 6 is subdivided into individual blocks 9 by segment-like interruptions 8.

On the inner side 10 of the cap base 2 there are arranged ribs 11 extending radially outwards. The ribs 11 extend radially until roughly in the region of the interruptions 8. With this it is essential that the sealing ribs 11 extend at least over one sealing section 12. The sealing section is defined by that region in which a sealing disk 5 by way of the effect of the cap base 10 or the sealing ribs 11 can be pressed against the opening of the container 20.

Figure 2:
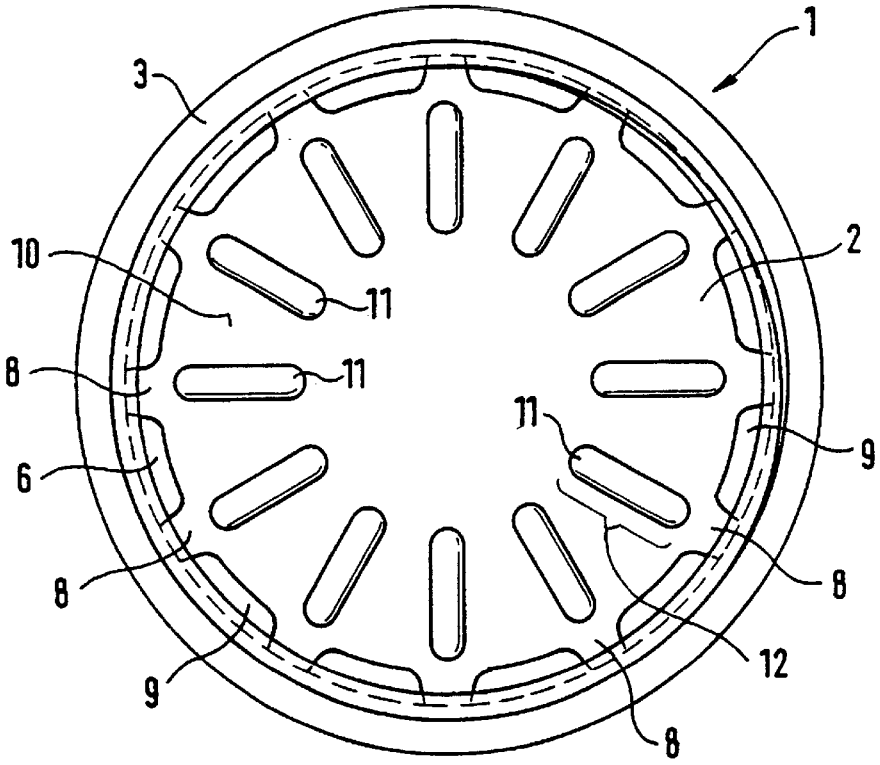
FIG. 2 a view from below of a closure cap without a sealing disk.

In FIG. 2 the closure cap of FIG. 1 is shown from below. For simplification of the representation the sealing disk 5 is likewise not shown. A multitude of individual blocks 9 are arranged in the transition region 7 between the cap base 2 and the cap skirt 3. The individual blocks 9 are separated from one another by interruptions 8. For each interruption 8 there is provided a rib 11 extending radially outwards. The ribs 11, the blocks 9 and the interruptions 8 are distributed uniformly in the circumferential direction over the inner side 10 of the cap base 2.

Figure 3:
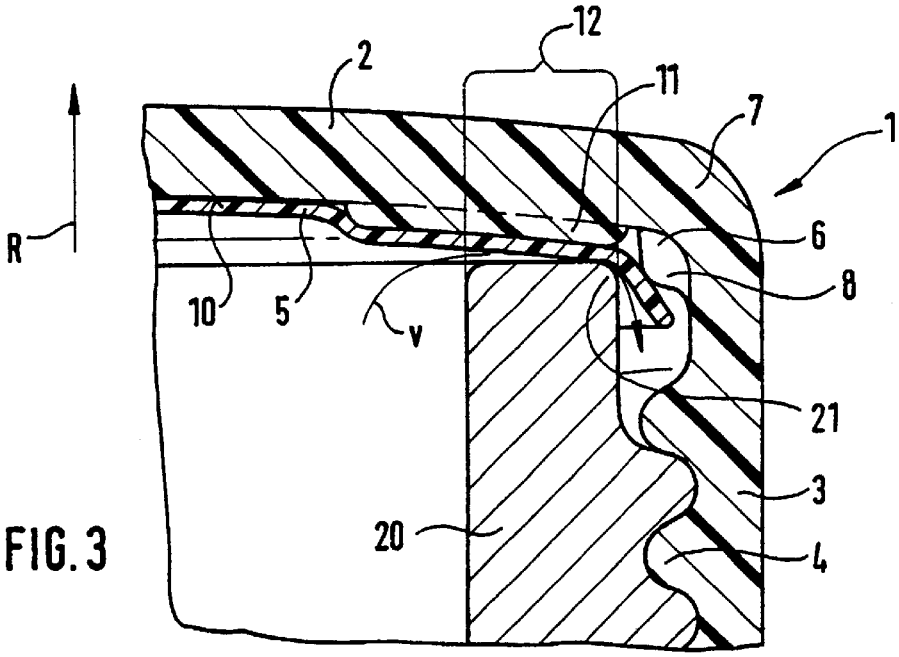
FIG. 3 a cross section through a cutout of a closure cap according to the invention.

FIG. 3 shows a cutout of a closure cap 1 according to the invention in cross section. The closure cap 1 with the cap skirt 3 is held on the neck of a container 20 by way of a screw thread 4. A sealing disk 5 is layed into the closure cap 1. The sealing disk 5 contacts essentially the inner side 10 of the cap base 2. The sealing disk 5 by the effect of the inner side 10 of the cap base 2 is pressed against the upper outer edge 21 of the container opening. The circumferential bulge 6 is arranged between the cap base 2 and the cap skirt 3. The bulge 6 comprises interruptions 8.

Furthermore, on the inner side 10 of the cap base 2 there is provided a rib 11 extending radially from the inside to the outside. The rib 11 presses the sealing disk 5 against the upper edge of the container opening 20 in a specific manner. The rib 11 extends essentially over a sealing section 12. In the sealing section 12 the sealing disk 5 is pressed against the container opening.

As shown in FIG. 2 for each interruption, between two blocks 9 there is arranged a radial rib 11. With a normal inner pressure the sealing disk 5, except in the region of the interruptions 8, is pressed by the blocks 9 against the upper outer edge 21 of the container and thereby seals. In the region of the interruptions 8, the sealing disk 5 is not pressed against the outer edge. By way of the ribs 11, however, the sealing disk 5 is pressed against the upper edge of the container opening. If the pressure in the container increases, the cap base 2 is curved upwards in the arrow direction R (so-called doming). With the doming the sealing disk 5 by way of the blocks 9 is still further sealingly pressed against the outer, upper edge of the container opening. However the ribs 11 lead to a relieving of pressure of the sealing disk 5 in the region of the interruptions 6. By way of this a path for venting is formed. The gas in the inside of the container closed by the closure cap 1 may escape between the individual blocks 9 through the interruptions 8. In FIG. 3 an interruption 8 is schematically shown. The blocks 9 are shown with dashed lines. The arrow V shows the way by which the gas reduction is effected.

What is claimed is:

1. A closure cap for a container comprising a cap base with an inner side a cap skirt with inner retaining elements which may be brought into engagement with outer retaining elements on the opening of the container, a sealing disk which at least partly bears on the cap base and with a bulge in a transition region between said cap base and said cap skirt for pressing said sealing disk onto an upper, outer edge of such opening of the container, wherein said bulge is subdivided by at least one segment-like interruption, into several blocks, wherein said inner side of said cap base has at least one rib which runs radially outwards and which extends radially at least over a sealing section on said inner side of said cap base and wherein said rib seen in the circumferential direction is arranged neighbouring one of said interruptions.

2. A closure cap according to claim 1, wherein there are several interruptions, and wherein at least on rib is arranged radially flush to each interruption.

3. A closure cap according to claim 1, wherein said rib has an angular extension smaller than the angular extension of said interruption.

4. A closure cap according to claim 1, wherein the closure cap has three to ten interruptions, three to ten blocks and three to ten radial ribs.

5. A closure cap according to claim 1, wherein said interruptions extend over an angular range of 5° to 30°.

* * * * *

UNITED STATES PATENT AND TRADEMARK OFFICE

CERTIFICATE OF CORRECTION

PATENT NO. : 6,502,710 B1
DATED : January 7, 2003
INVENTOR(S) : Bösl et al.

It is certified that error appears in the above-identified patent and that said Letters Patent is hereby corrected as shown below:

Title page,
Item [30], Foreign Application Priority Data, delete "98810913" and insert -- 98810913.8 -- therefor.

Column 2,
Line 33, delete "additionally" and insert -- additional -- therefor.
Line 65, delete "cap I" and insert -- cap 1 -- therefor.

Column 4,
Line 36, delete "at least on" and insert -- at least one -- therefor.

Signed and Sealed this

Thirtieth Day of September, 2003

JAMES E. ROGAN
*Director of the United States Patent and Trademark Office*